United States Patent [19]

Rizzardi

[11] Patent Number: 5,029,718

[45] Date of Patent: Jul. 9, 1991

[54] CLOSURE FOR BOTTLES AND THE LIKE COMPRISING A RESERVOIR WITH A BREAKABLE BOTTOM

[75] Inventor: Napoleone Rizzardi, Milan, Italy

[73] Assignee: Capsulit S.p.A., Milan, Italy

[21] Appl. No.: 391,444

[22] Filed: Aug. 9, 1989

[30] Foreign Application Priority Data

Sep. 1, 1988 [IT] Italy ..... 21785/88[U]
Sep. 1, 1988 [IT] Italy ..... 21786/88[U]

[51] Int. Cl.[5] ..... B65D 41/00
[52] U.S. Cl. ..... 215/254; 206/222
[58] Field of Search ..... 206/222; 215/253, 254

[56] References Cited

U.S. PATENT DOCUMENTS

| | | | |
|---|---|---|---|
| 3,840,136 | 10/1974 | Lanfranconi | 206/222 X |
| 3,866,782 | 2/1975 | Westfall | 215/253 |
| 4,195,731 | 4/1980 | Cavazza | 206/222 |
| 4,394,918 | 7/1983 | Grussen | 215/252 X |

FOREIGN PATENT DOCUMENTS

| | | | |
|---|---|---|---|
| 2738551 | 3/1978 | Fed. Rep. of Germany | 215/254 |
| 2077188 | 11/1970 | France . | |
| 2170772 | 2/1973 | France . | |
| 1042626 | 9/1966 | United Kingdom . | |

*Primary Examiner*—Stephen Marcus
*Assistant Examiner*—Nova Stucker
*Attorney, Agent, or Firm*—McGlew & Tuttle

[57] ABSTRACT

A closure for monodose bottles having a reservoir with a breakable bottom fittable into bottle openings. A cylindrical element having a lower end with a cutting edge is inserted in the reservoir. A sealing cap is fittable around a bottle neck, the sealing cap includes a top wall, and cylindrical wall connected by a breaking line which is easily manually broken, and provides a means by which the entire cap is removed to expose the cylindrical element.

10 Claims, 2 Drawing Sheets

CLOSURE FOR BOTTLES AND THE LIKE COMPRISING A RESERVOIR WITH A BREAKABLE BOTTOM

FIELD AND BACKGROUND OF THE INVENTION

The present invention relates to closures for bottles.

SUMMARY AND OBJECTIONS OF THE INVENTION

The object of the invention is to provide a closure of plastic material for monodose bottles and the like, of the kind enclosing a reservoir housed in the bottle-neck and containing a substance generally in powder form, which is dropped into the liquid contained in the bottle by breaking said reservoir.

The breaking of the bottom takes place by acting on a pressing element, provided with a cylindrical body, by penetrating a sideways cut formed on a cylindrical element. The operation is performed after the removal of a sealing cap which covers and protects the whole structure against any accidental blow or tampering.

The sealing cap can be made of aluminium or plastic.

As the bottles are monodose bottle, the sealing cap, once removed, must not be reused.

It is an object of the invention to render it as easy as possible for the user to remove the sealing cap.

Known sealing caps of plastic material are generally provided with a grip tongue; by pulling it a sealing wrapper is removed or breaking of the cap is caused along fixed breaking lines.

Said known caps are unlikely manually removable, because it is rather difficult to seize the tear tongue with a nail and also because there is a certain resistance in the tearing start.

Therefore it is often necessary to use a tool for opening the cap.

Moreover, if the grip tongue projects out of the peripheral surface of the cap, there are problems during the cap application, e.g. jamming of application machines, especially when these work at high speed.

It is a object of the invention to eliminate the above mentioned inconveniencies, by proposing a sealing cap of plastic material for closures, with a reservoir provided with a breakable bottom, said sealing cap being very simple and made very easy to use.

The sealing cap according to said invention shows a breaking line, which develops substantially all over the height of the sealing cap and extends in a circumpherence on the cap upper flat wall, in the area that connects said cap and the cover, with an interruption which produces a solid section, adjacent to the vertical breaking line, which is disposed on the cover.

In the upper part of the cover, at the side which is opposite to the one affected by the breaking line, a hollow cutting is provided, which extends till the cap upper wall, in order to form an inducement for the breaking of said cap.

In fact, acting for instance with the thumb in correspondence of the hollow cutting and exerting a pressure or traction upwards on the cap upper wall, at the beginning the breaking takes place along the circumpherence section of the breaking line provided on said cap, and then along the vertical section provided on the cover, producing the complete opening of the cap, which can be easily removed from the bottle.

The line along which the breaking takes place can be a weakening line of the material or a pre-fracturing line with small bridges connecting the parts of the cap to be separated, or a mixed line of weakening and pre-facturing.

The cap is positioned around the bottle-neck by means of a continuous or discontinuous anular raising, provided within its cover, showing an inner surface inclined in order to more easily pass over the bottle during the cap application to the bottle.

Preferably, the cap cover extends as far as it rests with its lower edge on the bottle shoulder, in order to avoid any removal of the cap from the bottle unless acting in said way.

From the cap upper wall a tubular projection comes down, which covers the pressing element and rests lower down on the reservoir anular edge, in order to avoid that accidental blows on said cap upper wall are transmitted to the pressing element, at the risk of breaking the reservoir breakable bottom.

BRIEF DESCRIPTION OF THE DRAWINGS

Further features of said invention will become clearer in the following detailed description, referred to a preferred exemplificative but not limitative embodiment, shown in the enclosed drawings, wherein.

DESCRIPTION OF THE PREFERRED EMBODIMENTS

Figure 1:
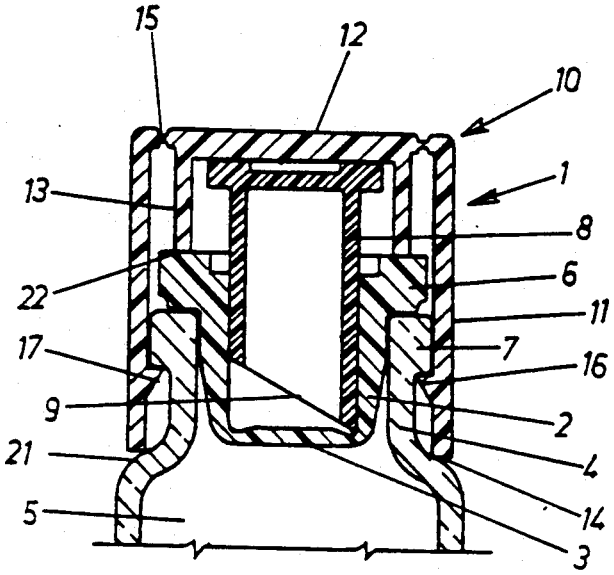
FIG. 1 is a sectional view of the closure according to the invention, applied to a bottle.

As regard to said figures, reference 1 indicates the whole closure according to the invention, enclosing a reservoir 2, provided with a breakable bottom 3, housed by forcing in the neck 4 of a bottle 5 and showing on the upper part an anular edge 6 superimposed to the anular edge 7 of the bottle opening.

In the reservoir 2 a cylindrical hollow element 8 is housed. The hollow element is provided at its lower end 9 with an angular cutting surface 30.

During the use, the pressing of the cylindrical element 8 downwards causes the breaking of the breakable bottom 3, and determines the dropping of a substance in powder form contained in the reservoir 2 into the liquid contained in the bottle 5, to which it has to be mixed.

Both the reservoir 2 and the cylindrical element 8 are of plastic material and are enclosed in a sealing cap 10, of plastic material, too.

Figure 2:
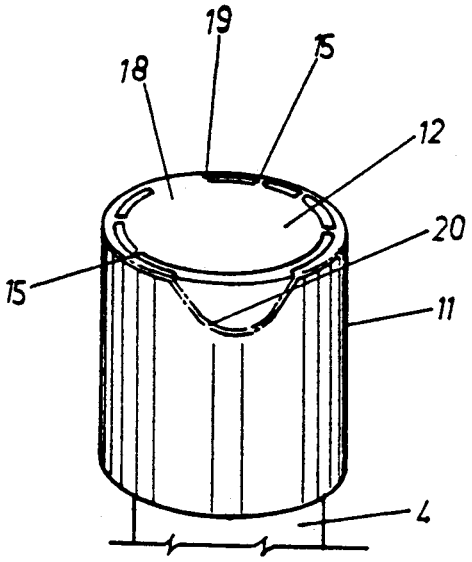
FIG. 2 is an axonometric view of the closure shown in FIG. 1
Figure 3:
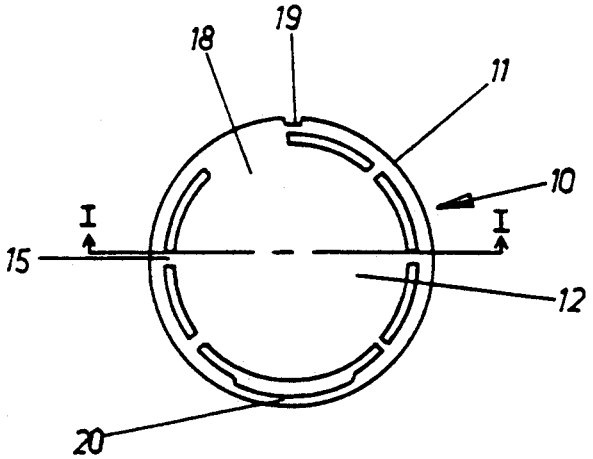
FIG. 3 is a top plan view of the sealing cap before the breaking.

The cap 10 shows a peripheral cover 11, disposed around the neck 2 of the bottle and an upper flat wall 12, connected to the cover 11 by small connecting bridges 15, in order to constitute a circular breaking line, interrupted in a section 18 (see FIGS. 2 and 3), which avoids the complete separation of the wall 12 from the cover 11 during the cap opening, as described better later on.

Of course, the connection between the cover 11 and the cap upper wall 12 can also be constituted by a material weakening line.

Within the cover 11 a continuous or discontinuous anular raising 16 is provided, which engages, owing to a transitory elastic deformation, below the anular edge 7 of the bottle opening.

The anular raising shows an inner inclination or chamfer 17 apt to facilitate the application of the cap to the bottle.

The raising 16 may be made of solid material, as shown in FIG. 1, or in the shape of flexible tabs, in order to have greater elasticity.

The cover 11 of the cap 10 can rest with its lower edge 14 immediately under the anular edge 7 of the bottle opening, or, more conveniently, extend till the bottle shoulder 21, as shown in FIG. 1.

this last solution allows in any case the cap to break, if an attempt is made to extract it from the bottle, without performing the correct operations, described later on.

On the cover 11 of the cap 10 a weakening or a pre-fracturing line 19 is provided, which extends substantially upright all over the height of said cover and is connected to the circular breaking line provided on the cap upper flat wall 12, in correspondence of said solid section 18.

At the opposite site of the breaking line 19 a cutting 20 is provided, upwards hollow and extending to the circular breaking line provided on the cap upper wall 12, in order to facilitate the removal of said cap.

Then, from the upper flat wall 12 of the cap 10 an inner tubular continuous or discontinuous annular projection 13 projects downward encircling the upper part of the cylindrical element 8.

The lower edge 22 of the tubular raising 13 rests on the anular edge 6 of the reservoir 2, in order to avoid that accidental blows on the cap upper wall or top surface 12 are transmitted to the cylindrical element 8, at the risk of breaking the breakable bottom 3.

The removal of the cap 10 takes place acting with the finger of a hand, possibly with a thumb in correspondence with a cut out portion 20 provided on a circumferential position of the cover 11. A pressure or a traction is exerted upwardly on the cap top surface 12, causing the breaking of the small bridges 15, which connect the cap to the cover 11. The complete breakaway of the top surface 12 from the cap 10 is prevented by the solid section 18. By continuing to exert a traction on the cap flat wall 12, the breaking of the weakening or pre-fracturing line 19, running vertically along the length of cover 11, is caused, thereby completely removing the cap from the bottle.

With reference to figures from 3 to 6, reference 101 indicates the whole closure according to a second embodiment of the invention, enclosing a reservoir 102, provided with a breakable bottom 103, housed by forcing in the neck 104 of a bottle 105 and showing in the upper part an anular edge 106, superimposed to the anular edge 107 of the bottle opening. In the reservoir 102 a cylindrical hollow element 108 is housed, whith its lower end 109 sideways cut.

During the use, the pressing of the cylindrical element 108 downwards causes the breaking of the breakable bottom 103, and determines the dropping of a substance in powder contained in the reservoir 102 into the liquid contained in the bottle 105, to which it has to be mixed.

Both the reservoir 102 and the cylindrical element 108 are of plastic material and are enclosed in a sealing cap 110, of plastic material, too.

The cap 110 has a lower cylindrical section 111, covering at least the upper part of the bottle-neck 104, and an upper cylindrical section 112, of a reduced diameter, covering the pressing element 108.

The reduced diameter of the cylindrical section 112 causes the resting of its lower edge 113 on the anular edge 106 of the reservoir 102, in order to avoid that accidental blows on the upper part 114 of the cap 110 are transmitted to the cylindrical element 108, at the risk of breaking the breakable bottom 103.

The two cylindrical sections 111 and 112 are interconnected to each other by an anular flat wall 115.

Close to the lower edge of the cylindrical section 111 a continuous or dicontinuous inner annular raising 116 is provided, engaging, owing to a transitory elastic deformation, below the anular edge 107 of the bottle opening.

Figure 4:
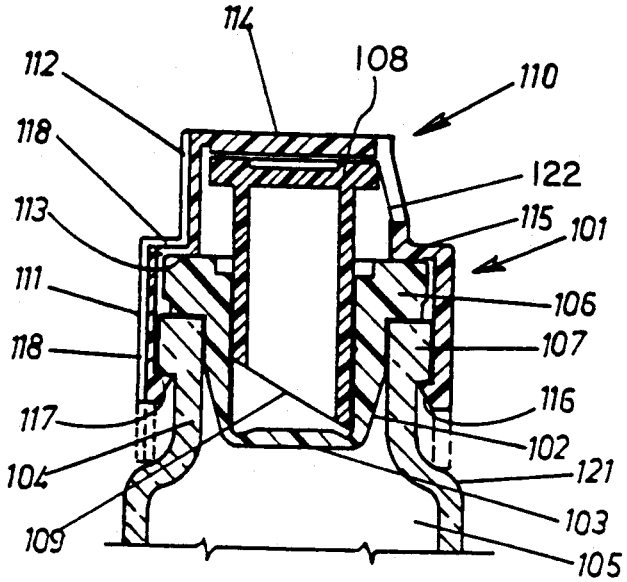
FIG. 4 is a sectional view of a different embodiment of the closure according to the invention, applied to a bottle, taken along the line IV—IV of FIG. 6.

The raising 116 may be made of solid material, as shown in FIG. 4, or in the shape of flexible tabs, in order to have greater elasticity.

The cylindrical section 111 of the cap 110 can rest with its lower edge immediately below the anular edge 107 of the bottle opening or extend to the bottle shoulder 121, as shown by the dash line in FIG. 4.

This last solution causes the cap to break if an attempt is made to extract it from the bottle without performing the correct opening operations, described later on.

Figure 5:
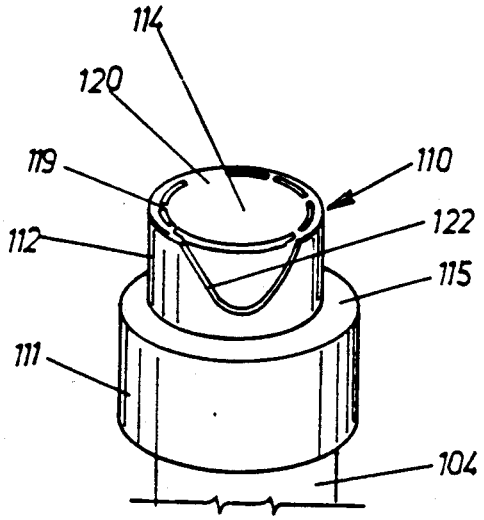
FIG. 5 is an axonometric view of the closure shown in FIG. 4.
Figure 6:
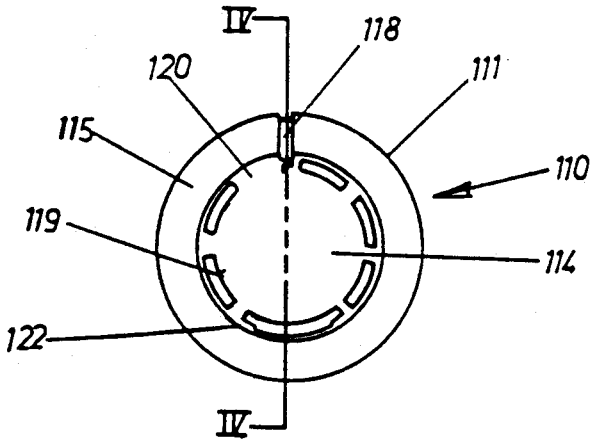
FIG. 6 is a top plan view of the sealing cap shown in FIG. 4, before breaking.

The upper flat wall 114 of the cap 110 is connected to the cylindrical section 112 by small connection bridges 119, in order to determine a circular breaking line, as shown in FIG. 5 and 6.

It is clear that the interconnection between the flat wall 114 and the cylindrical section 112 can also be constituted by a material weakening line.

The circular breaking line is interrupted by a solid section 120, close to which it is connected to a weakening or pre-fracturing line 118, extending substantially upright all over the cap height, and affecting the two cylindrical sections 111 and 112 and the flat anular wall, which interconnects them.

On the upper cylindrical section 112, at the side opposite to the one affected by the breaking line 118, a curved cutting 122 is provided, which is concave upward, thereby exposing an edge of the flat wall 114 and enabling the edge to be pushed upwardly to cause the flat wall to separate from the cylindrical section 112.

The removal of the cap 110 takes place by acting with the finger of a hand, preferably the thumb, in correspondence of the cutting 122 and exerting a pressure or a traction upwards on the upper flat wall 14, causing at the beginning the breaking of the small bridges 119, which connect said flat wall to the cap upper cylindrical section 112, without determining the complete breakaway because of the solid section 120.

Continuing to exert a traction on the flat wall 114, the breaking continues along line 118, which extends all over the height of the cap, and causes the complete opening of said cap and then an easy removal from the bottle.

Of course the invention is not restricted to the peculiar embodiments previously described and shown in the enclosed drawings, but it is possible to introduce detail changes within the reach of the branch experts, without departing from the scope of the invention.

I claim:

1. A bottle closure arrangement, comprising: a bottle having an upper annular edge surrounding an upper bottle opening; a reservoir having an annular edge seated on the bottle opening annular edge and defining a reservoir space extending into said bottle opening, said reservoir having a weakened portion defining a breakable bottom; a cylindrical element inserted into said reservoir space, said cylindrical element having a lower end with a cutting surface in contact with said breakable bottom, said cutting surface for acting on said weakened portion for breaking said breakable bottom to provide communication between said reservoir and said bottle, said cylindrical element having an opposite engagement surface for pressing said cylindrical element downwardly; a sealing cap positioned over said reservoir, said sealing cap including a sealing cap cylindrical wall and a sealing cap top portion, said sealing cap top portion being connected to said sealing cap cylindrical wall by a solid section width and by regions of reduced material, substantially less than said solid section, extending from said solid section in each direction about a portion of a periphery of said top portion except for a non-connected region substantially opposite said solid surface, said sealing cap including means fixing for maintaining said sealing cap in a position relative to said bottle, said reservoir and said cylindrical element to prevent an inner surface of said top portion from forcing said cylindrical element into said breakable bottom and a cut-out portion formed in said sealing cap cylindrical wall defining an opening at said non-connected area, said opening providing communication with said lower portion of said top surface from outside said sealing cap whereby said lower surface may be forced upwardly breaking said regionns of reduced material as said top surface pivots about said solid section, allowing access to said cylindrical element for forcing said cylindrical element downwardly to break said breakable bottom.

2. A closure according to claim 1, wherein said sealing cap cylindrical wall includes a pre-fracturing section extending substantially vertically along the length of said cylindrical wall, said top surface solid section being positioned adjacent said pre-fracturing section.

3. A closure according to claim 1, wherein said cap fixing means includes a tubular projection projecting downwardly from said top surface, said projection resting on said annular edge of said reservoir element.

4. A closure according to claim 1, wherein said sealing cap includes a lower cylindrical section and an upper cylindrical section, said upper cylindrical section being of a reduced diameter in comparison with said lower cylindrical section, said lower cylindrical section being connected to said upper cylindrical section by an annular wall, said annular wall resting on said annular edge of said reservoir and forming a part of said fixing means.

5. A closure according to claim 3, wherein said cylindrical wall includes said cut-out portion.

6. A closure according to claim 1, wherein said sealing cap includes an annular lip forming a part of said fixing means which can be lockingly engaged over a bottle neck, said lip having a bottom portion being inclined thereby providing a means for applying said sealing cap to bottles.

7. A closure according to claim 6, wherein said annular lip is made of solid material.

8. A closure according to claim 1, wherein said sealing cap cylindrical wall includes a lower edge which projects below said bottle opening.

9. A closure according to claim 1, wherein said cylindrical wall includes a lower edge which extends to a bottle shoulder.

10. A bottle closure arrangement, comprising: a bottle having an upper annular edge surrounding an upper bottle opening; a reservoir having an annular edge seated on the bottle opening annular edge and defining a reservoir space extending into said bottle opening, said reservoir having a weakened portion defining a breakable bottom; a cylindrical element inserted into said reservoir space, said cylindrical element having a lower end with a cutting surface in contact with said breakable bottom, said cutting surface for acting on said weakened portion for breaking said breakable bottom to provide communication between said reservoir and said bottle, said cylindrical element having an opposite engagement surface for pressing said cylindrical element downwardly; a sealing cap positioned over said reservoir, said sealing cap including a sealing cap cylindrical wall and a sealing cap top surface, said sealing cap top surface being connected to said sealing cap cylindrical wall by a solid section having a material with and by the bridge sections having a material with substantially less than said solid section, said bridge sections being provided at spaced locations beginning at a location spaced from said solid section extending about a periphery of said top surface except for a non-connected region substantially opposite said solid surface, said sealing cap including fixing means for maintaining said sealing cap in a position relative to said bottle, said reservoir and said cylindrical element to prevent an inner surface of said top surface from forcing said cylindrical element into said breakable bottom and a cut-out portion formed in said sealing cap cylindrical wall defining an opening at said nonconnected area, said opening providing communication with said lower surface of said top surface from outside said sealing cap whereby said lower surface may be forced upwardly breaking said connecting bridges as said top surface pivots about said solid section, allowing access to said cylindrical element for forcing said cylindrical element downwardly to break said breakable bottom said sealing cap cylindrical wall including a pre-fracturing section extending substantially vertically along the length of said cylindrical wall, said top surface solid section being positioned adjacent said pre-fracturing section.

* * * * *